US006488363B2

(12) United States Patent
Torgerson et al.

(10) Patent No.: US 6,488,363 B2
(45) Date of Patent: Dec. 3, 2002

(54) ENERGY BALANCED PRINTHEAD DESIGN

(75) Inventors: Joseph M. Torgerson, Philomath, OR (US); Robert N. K. Browning, Corvallis, OR (US); Mark H. MacKenzie, Corvallis, OR (US); Patrick V. Boyd, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/022,985

(22) Filed: Dec. 17, 2001

(65) Prior Publication Data

US 2002/0140779 A1 Oct. 3, 2002

Related U.S. Application Data

(63) Continuation of application No. 09/773,180, filed on Jan. 30, 2001, now Pat. No. 6,412,917.

(51) Int. Cl.[7] ..... B41J 2/05
(52) U.S. Cl. ..... 347/58; 347/59
(58) Field of Search ..... 347/57–59, 63, 347/65; 257/342, 920

(56) References Cited

U.S. PATENT DOCUMENTS

| | | | | | |
|---|---|---|---|---|---|
| 4,251,824 | A | * | 2/1981 | Hara et al. | 347/57 |
| 4,345,262 | A | * | 8/1982 | Shirato et al. | 347/57 |
| 5,272,489 | A | | 12/1993 | Kobayashi et al. | 347/206 |
| 5,469,203 | A | | 11/1995 | Hauschild | 347/190 |
| 5,638,101 | A | * | 6/1997 | Keefe et al. | 347/65 |

* cited by examiner

*Primary Examiner*—John Barlow
*Assistant Examiner*—Juanita Stephens

(57) ABSTRACT

A narrow ink jet printhead having efficient FET drive circuits that are configured to compensate for parasitic resistances of power traces. The ink jet printhead further includes ground busses that overlap active regions of the FET drive circuits.

29 Claims, 12 Drawing Sheets

ENERGY BALANCED PRINTHEAD DESIGN

CROSS REFERENCE TO RELATED APPLICATION(S)

This is a continuation of application Ser. No. 09/773,180 filed on Jan 30, 2001, now U.S. Pat. No. 6,412,917 B1 which is hereby incorporated by reference herein.

BACKGROUND OF THE INVENTION

The subject invention generally relates to ink jet printing, and more particularly to a thin film ink jet printhead having FET drive circuits configured to compensate for parasitic resistances of power traces.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The ink barrier layer is typically a polymer material that is laminated as a dry film to the thin film substructure, and is designed to be photodefinable and both UV and thermally curable. In an ink jet printhead of a slot feed design, ink is fed from one or more ink reservoirs to the various ink chambers through one or more ink feed slots formed in the substrate.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

Considerations with thin film ink jet printheads include increased substrate size and/or substrate fragility as more ink drop generators and/or ink feed slots are employed. There is accordingly a need for an ink jet printhead that is compact and has a large number of ink drop generators.

SUMMARY OF THE INVENTION

The disclosed invention is directed to an ink jet printhead having efficient heater resistor energizing FET drive circuits that are configured to compensate for variations in parasitic resistances of power traces.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1A:
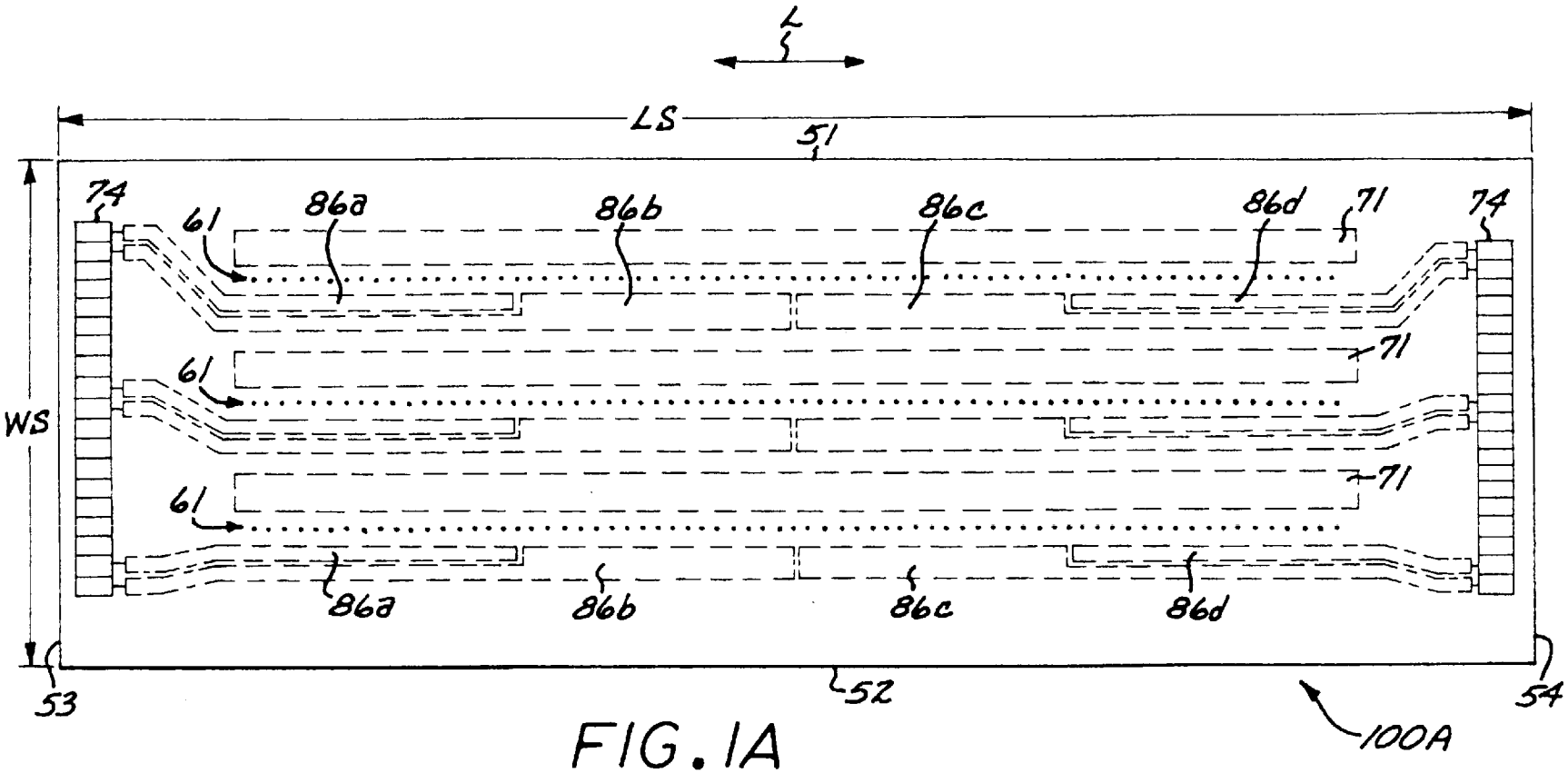
FIG. 1A is an unscaled schematic top plan view illustration of the layout of ink drop generators and primitive select of an ink jet printhead that employs the invention.

In the following detailed description and in the several figures of the drawing, like elements are identified with like reference numerals.

Referring now to FIGS. 1A–4A, and 1B–4B, schematically illustrated therein are unscaled schematic plan views and perspective views of ink jet printheads 100A, 100B in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 laminarly attached to the top of the ink barrier 12.

Figure 5:
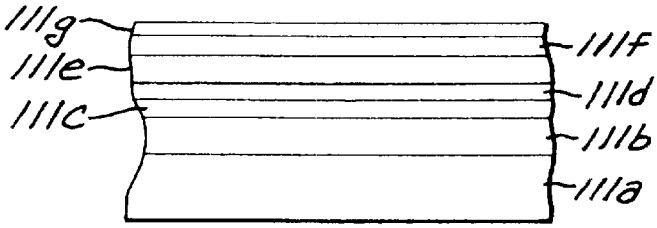
FIG. 5 is a schematic depiction of generalized layers of the thin film substructure of the printheads of FIGS. 1A and 1B.

The thin film substructure 11 comprises an integrated circuit die that is formed for example pursuant to conventional integrated circuit techniques, and as schematically depicted in FIG. 5 generally includes a silicon substrate 111*a*, an FET gate and dielectric layer 111*b*, a resistor layer 111*c*, and a first metallization layer 111*d*. Active devices such as drive FET circuits described more particularly herein are formed in the top portion of the silicon substrate 111*a* and the FET gate and dielectric layer 111*b*, which includes a gate oxide layer, polysilicon gates, and a dielectric layer adjacent the resistor layer 111*c*. Thin film heater resistors 56 are formed by the respective patterning of the resistor layer 111*c* and the first metallization layer 111*d*. The thin film substructure further includes a composite passivation layer 111*e* comprising for example a silicon nitride layer and a silicon carbide layer, and a tantalum mechanical passivation layer 111*f* that overlies at least the heater resistors 56. A gold conductive layer 111*g* overlies the tantalum layer 111*f*.

The ink barrier layer 12 is formed of a dry film that is heat and pressure laminated to the thin film substructure 11 and photodefined to form therein ink chambers 19 disposed over heater resistors 56 and ink channels 29. Gold bonding pads 74 engagable for external electrical connections are formed in the gold layer at longitudinally spaced apart, opposite ends of the thin film substructure 11 and are not covered by the ink barrier layer 12. By way of illustrative example, the barrier layer material comprises an acrylate based photopolymer dry film such as the "Parad" brand photopolymer dry film obtainable from E.I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

Figure 3A:
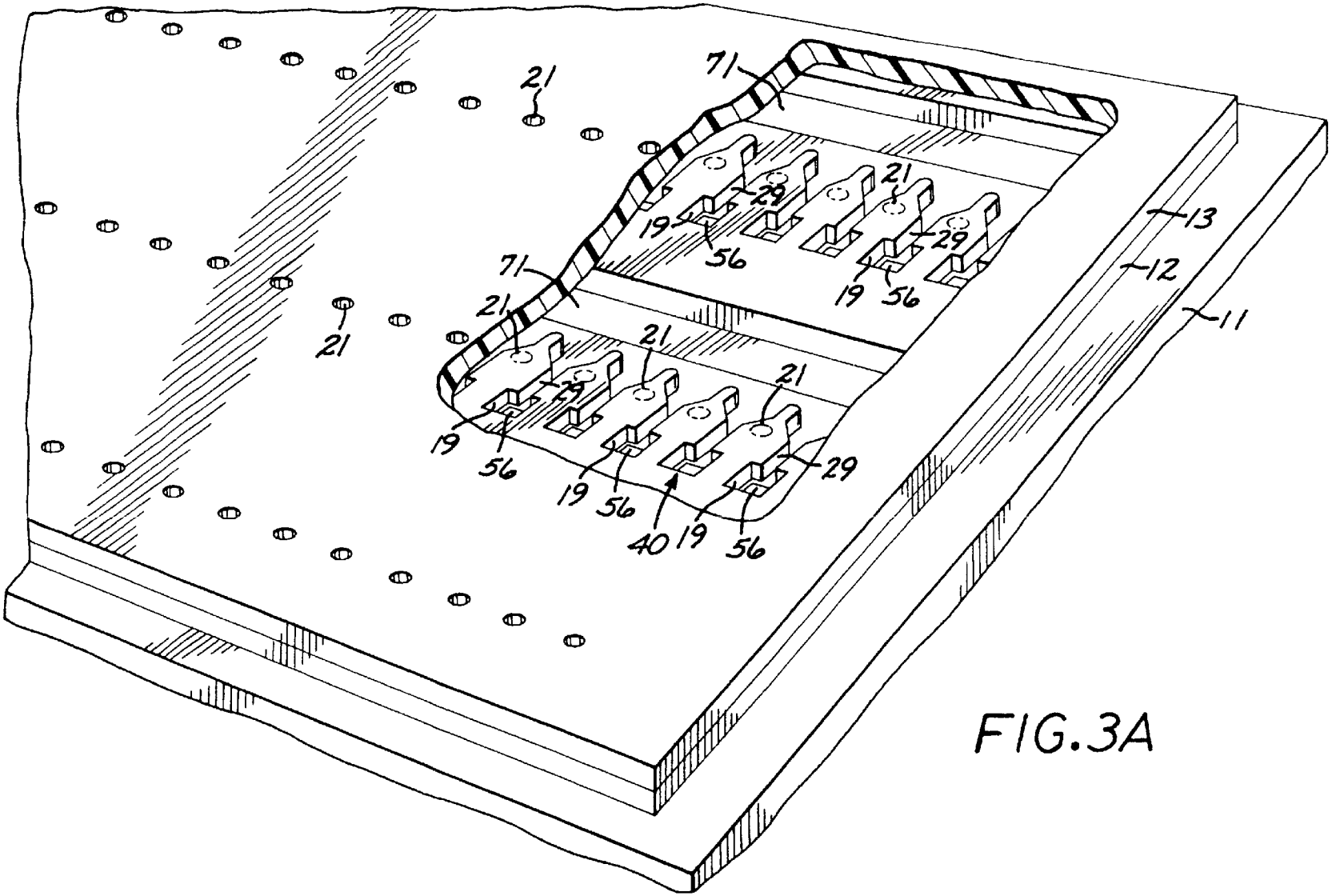
FIG. 3A is a schematic, partially broken away perspective view of the ink jet printhead of FIG. 1A.
Figure 3B:
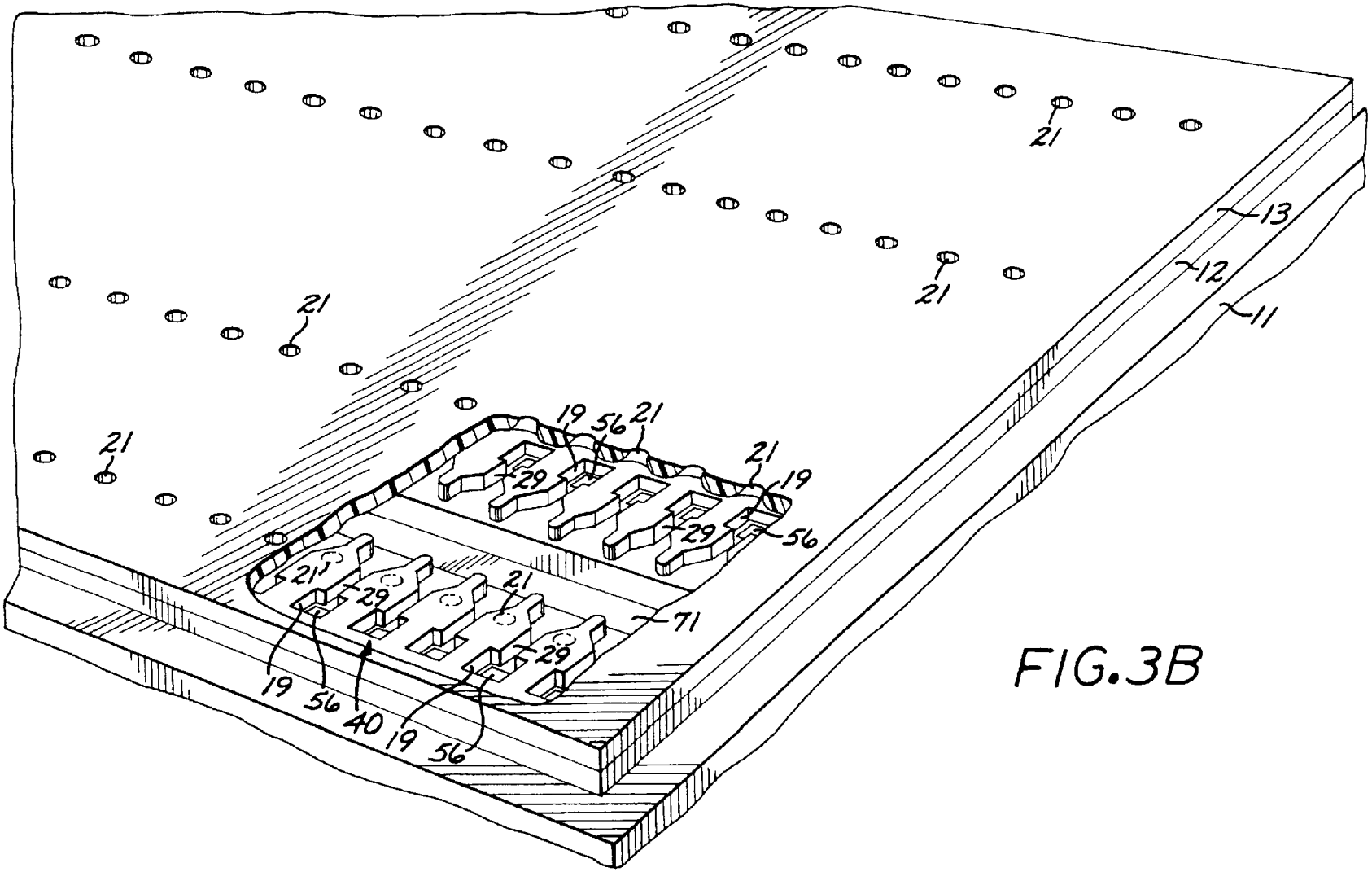
FIG. 3B is a schematic, partially broken away perspective view of the ink jet printhead of FIG. 1B.
Figure 4A:
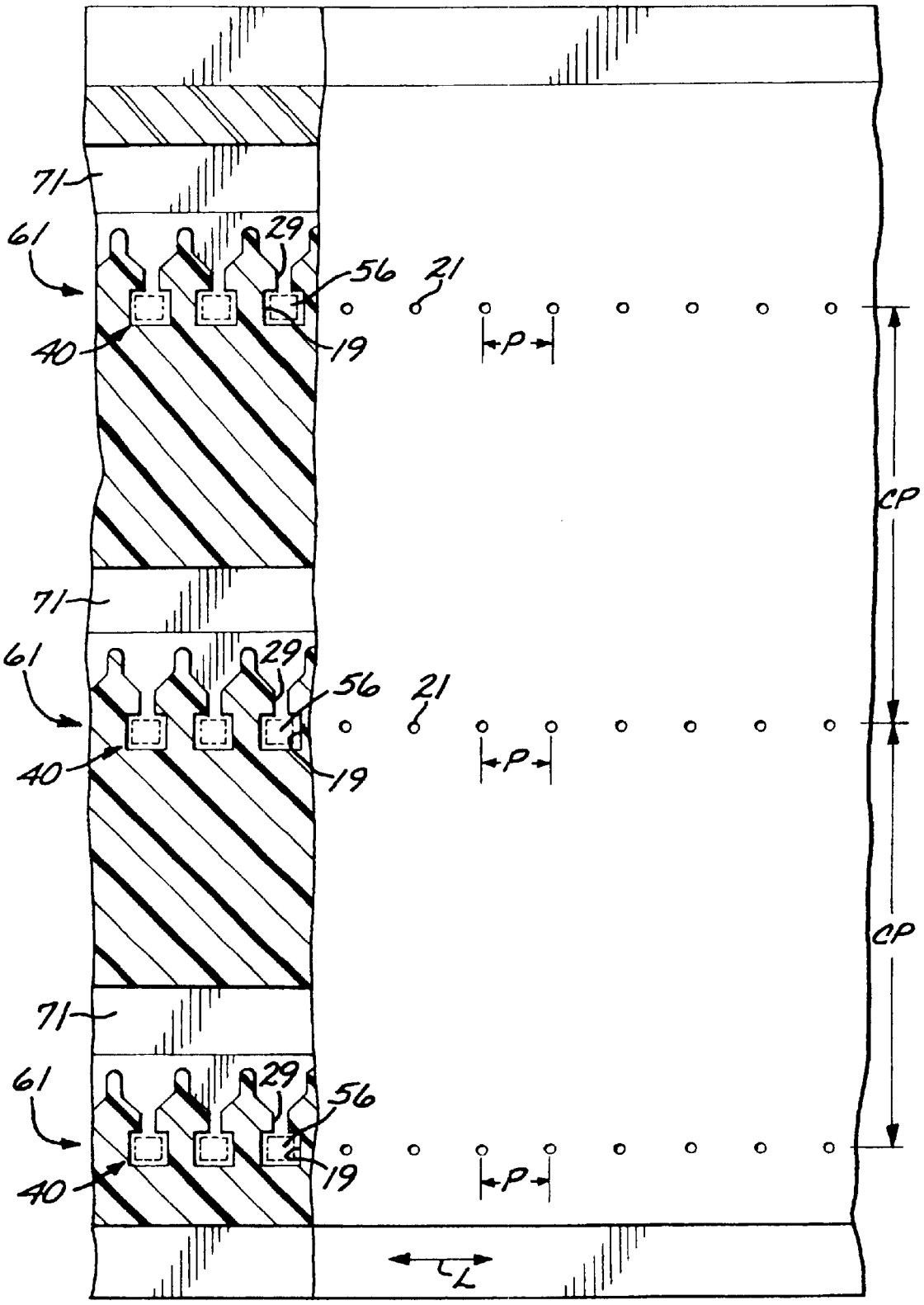
FIG. 4A is an unscaled schematic partial top plan illustration of the ink jet printhead of FIG. 1A.
Figure 4B:
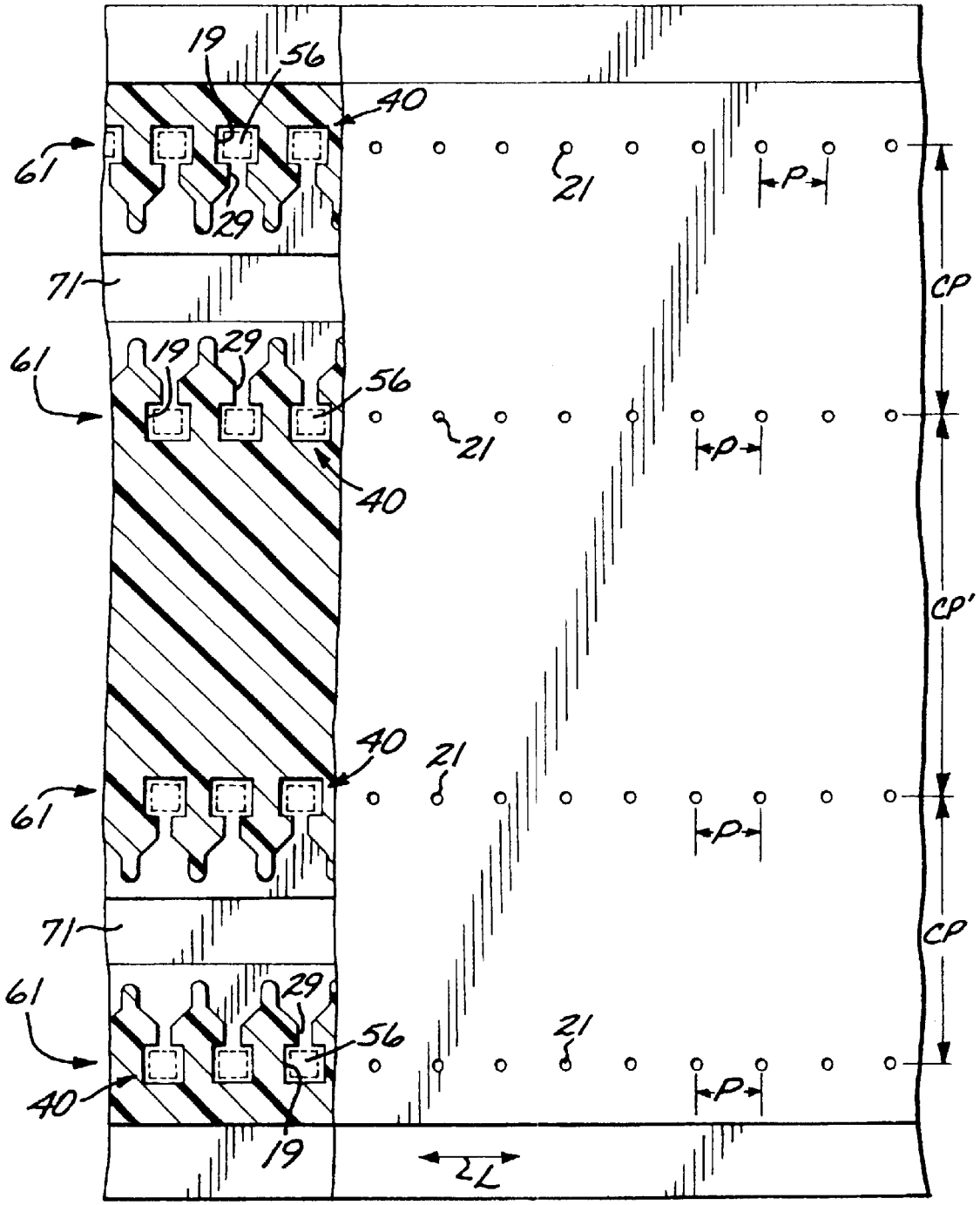
FIG. 4B is an unscaled schematic partial top plan illustration of the ink jet printhead of FIG. 1B.

As depicted in FIGS. 3A and 3B, the ink chambers 19 in the ink barrier layer 12 are more particularly disposed over respective ink firing heater resistors 56, and each ink chamber 19 is defined by interconnected edges or walls of a chamber opening formed in the barrier layer 12. The ink channels 29 are defined by further openings formed in the barrier layer 12, and are integrally joined to respective ink firing chambers 19. The ink channels 29 open towards a feed edge of an adjacent ink feed slot 71 and receive ink from such ink feed slot.

Figure 9:
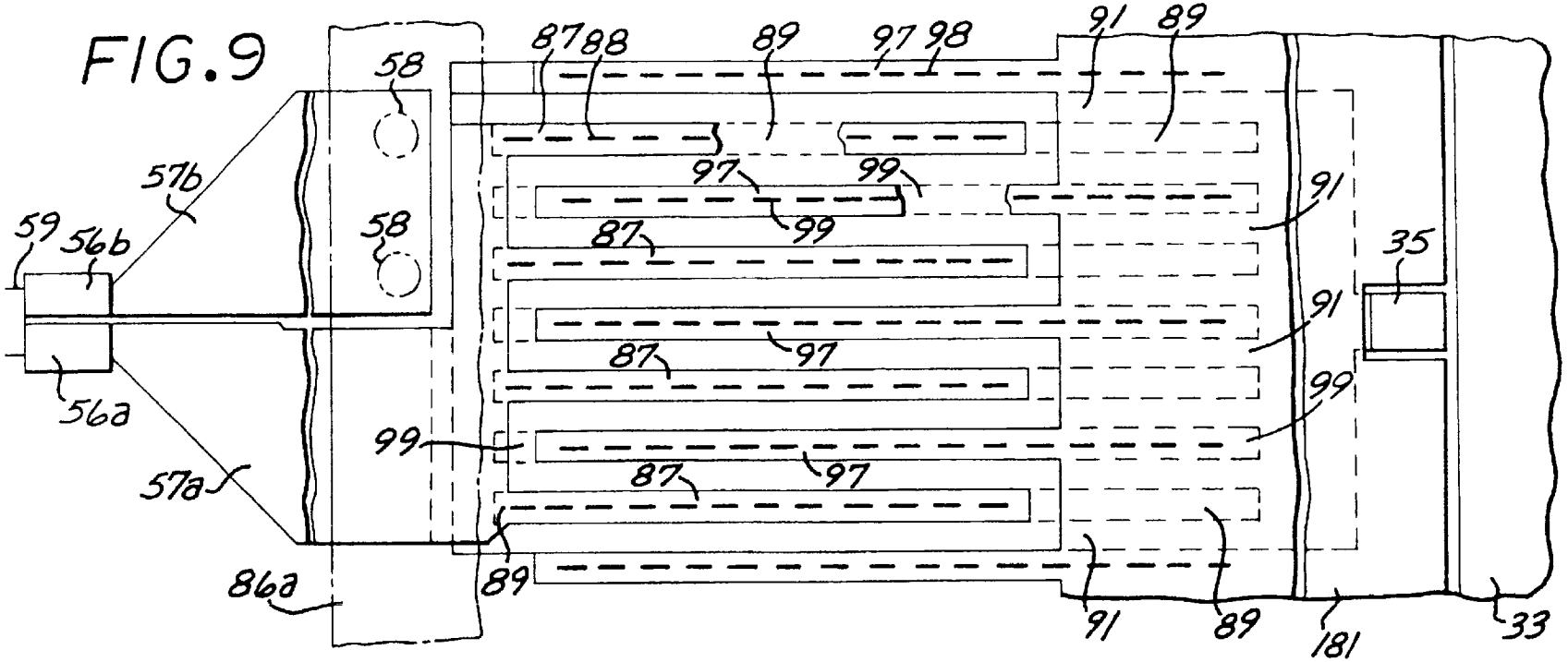
FIG. 9 is a schematic plan view of an illustrative implementation of an FET drive circuit and a ground bus of the printheads of FIGS. 1A and 1B.

The orifice plate 13 includes orifices or nozzles 21 disposed over respective ink chambers 19, such that each ink firing heater resistor 56, an associated ink chamber 19, and an associated orifice 21 are aligned and form an ink drop generator 40. Each of the heater resistors has a nominal resistance of at least 100 ohms, for example about 120 or 130 ohms, and can comprise a segmented resistor as shown in FIG. 9, wherein a heater resistor 56 is comprised of two resistor regions 56*a*, 56*b* connected by a metallization region 59. This resistor structure provides for a resistance that is greater than a single resistor region of the same area.

While the disclosed printheads are described as having a barrier layer and a separate orifice plate, it should be appreciated that the printheads can be implemented with an integral barrier/orifice structure that can be made, for example, using a single photopolymer layer that is exposed with a multiple exposure process and then developed.

The ink drop generators 40 are arranged in columnar arrays or groups 61 that extend along a reference axis L and are spaced apart from each other laterally or transversely relative to the reference axis L. The heater resistors 56 of each ink drop generator group are generally aligned with the reference axis L and have a predetermined center to center spacing or nozzle pitch P along the reference axis L. The nozzle pitch P can be 1/600 inch or greater, such as 1/300 inch. Each columnar array 61 of ink drop generators includes for example 100 or more ink drop generators (i.e., at least 100 ink drop generators).

By way of illustrative example, the thin film substructure 11 can be rectangular, wherein opposite edges 51, 52 thereof are longitudinal edges of a length dimension LS while longitudinally spaced apart, opposite edges 53, 54 are of a width or lateral dimension WS that is less than the length LS of the thin film substructure 11. The longitudinal extent of the thin film substructure 11 is along the edges 51, 52 which can be parallel to the reference axis L. In use, the reference axis L can be aligned with what is generally referred to as the media advance axis. For convenience, the longitudinally separated ends of the thin film substructure will also be referred to by the reference number 53, 54 used to refer to the edges at such ends.

While the ink drop generators 40 of each columnar array 61 of ink drop generators are illustrated as being substantially collinear, it should be appreciated that some of the ink drop generators 40 of an array of ink drop generators can be slightly off the center line of the column, for example to compensate for firing delays.

Insofar as each of the ink drop generators 40 includes a heater resistor 56, the heater resistors are accordingly arranged in columnar groups or arrays that correspond to the columnar arrays of ink drop generators. For convenience, the heater resistor arrays or groups will be referred to by the same reference number 61.

The thin film substructure 11 of the printhead 100A of FIGS. 1A, 2A, 3A, 4A more particularly includes three ink feed slots 71 that are aligned with the reference axis L, and are spaced apart from each other transversely relative to a reference axis L. The ink feed slots 71 respectively feed three ink drop generator groups 61, and by way of illustrative example are located on the same side of the ink drop generator groups that they respectively feed. In this manner, each of the ink feed slots 71 feeds ink along a single feed edge. By way of specific example, each of the ink feed slots provides ink of a color that is different from the color of the ink provided by the other ink feed slots, such as cyan, yellow and magenta.

The thin film substructure 11 of the printhead 100B of FIGS. 1B, 2B, 3B, 4B more particularly includes two ink feed slots 71 that are aligned with the reference axis L, and are spaced apart from each other transversely relative to the reference axis L. The ink feed slots 71 respectively feed four columns 61 of ink drop generators respectively located on opposite sides of the two ink feed slots 71, wherein the ink channels open towards an edge formed by an associated ink feed slot in the thin film substructure. In this manner, opposite edges of each ink feed slot forms a feed edge and each of the two ink feed slots comprises a dual edge ink feeding slot. By way of specific implementation, the printhead 100B of FIGS. 1B, 2B, 3B, 4B is a monochrome printhead wherein both ink feed slots 71 provides ink of the same color such as black, such that all four columns 61 of ink drop generators produce ink drops of the same color.

Figure 1B:
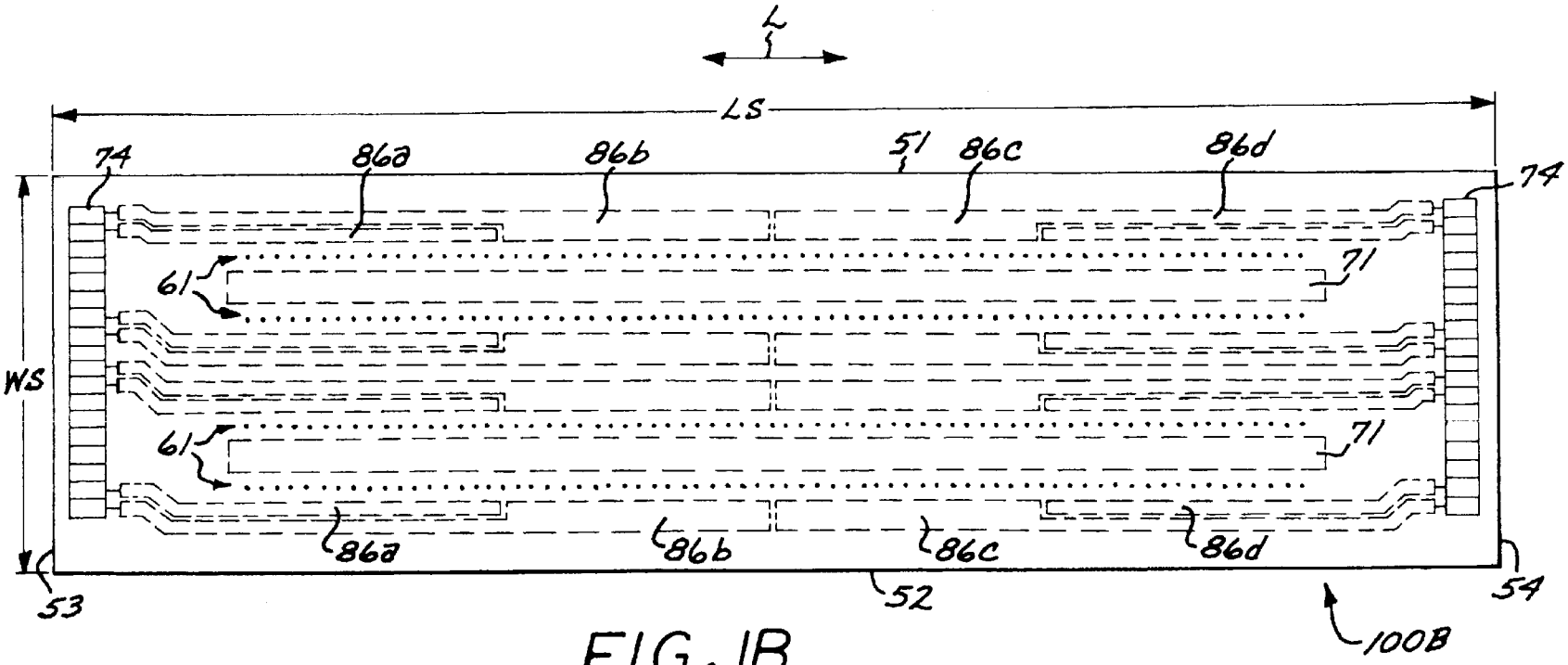
FIG. 1B is an unscaled schematic top plan view illustration of the layout of ink drop generators and primitive select of an ink jet printhead that employs the invention.
Figure 2A:
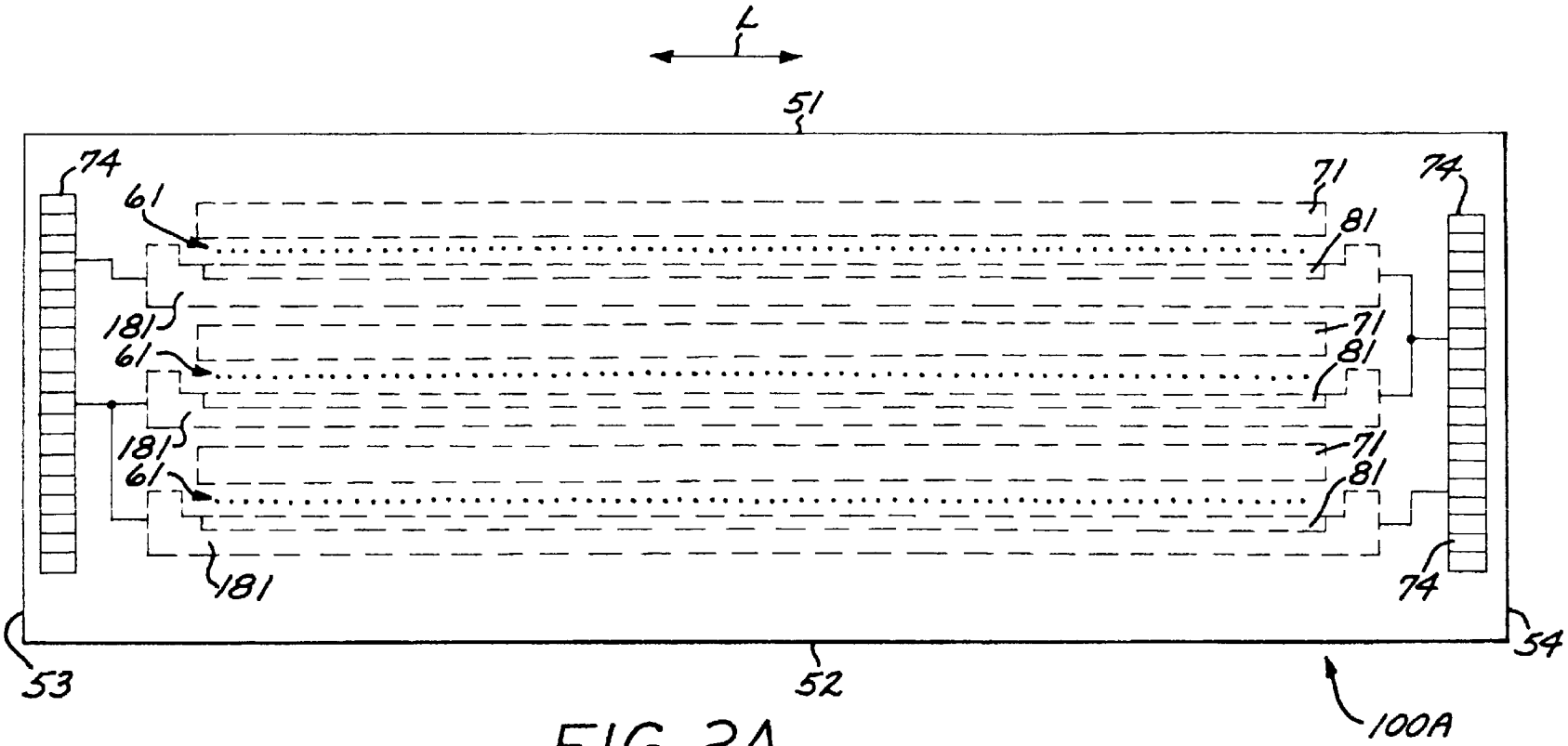
FIG. 2A is an unscaled schematic top plan view illustration of the layout of ink drop generators and ground busses of the ink jet printhead of FIG. 1A.
Figure 2B:
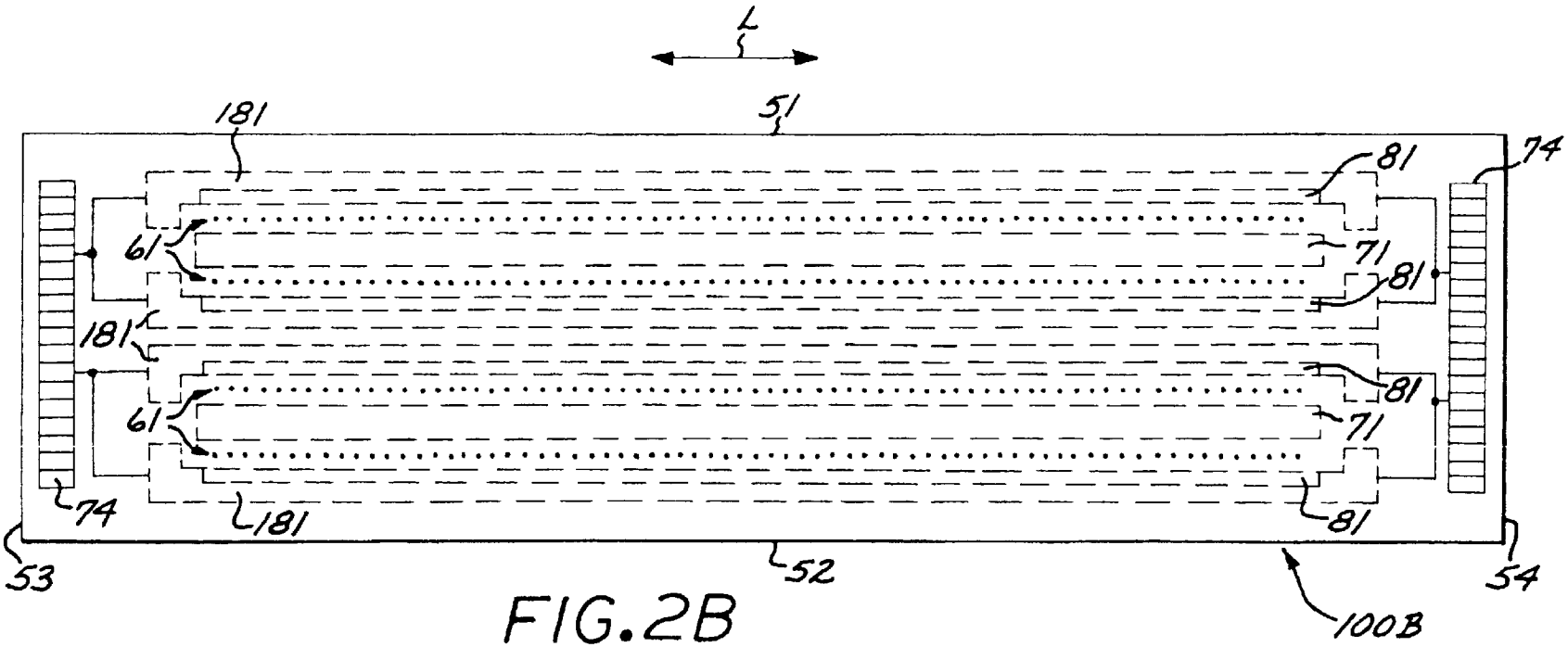
FIG. 2B is an unscaled schematic top plan view illustration of the layout of ink drop generators and ground busses of the ink jet printhead of FIG. 1B.
Figure 6:
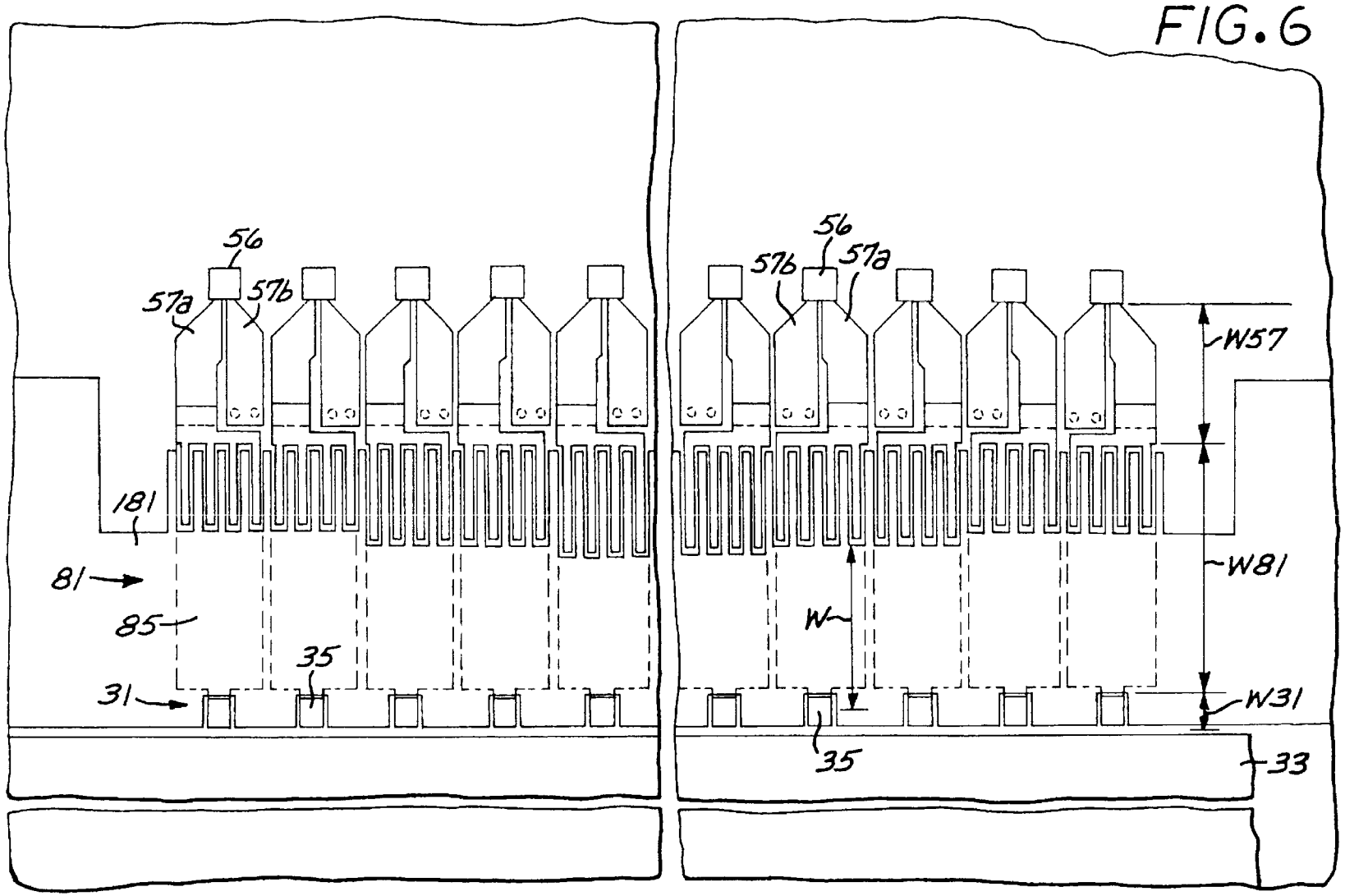
FIG. 6 is a partial top plan view generally illustrating the layout of a representatve FET drive circuit array and a ground bus of the printheads of FIGS. 1A and 1B.

Respectively adjacent and associated with the columnar arrays 61 of ink drop generators 40 are columnar FET drive circuit arrays 81 formed in the thin film substructure 11 of the printheads 100A, 100B, as schematically depicted in FIG. 6 for a representative columnar array 61 of ink drop generators. Each FET drive circuit array 81 includes a plurality of FET drive circuits 85 having drain electrodes respectively connected to respective heater resistors 56 by heater resistor leads 57*a*. Associated with each FET drive circuit array 81 and the associated array of ink drop generators is a columnar ground bus 181 to which the source electrodes of all of the FET drive circuits 85 of the associated FET drive circuit array 81 are electrically connected. Each columnar array 81 of FET drive circuits and the associated ground bus 181 extend longitudinally along the associated columnar array 61 of ink drop generators, and are at least longitudinally co-extensive with the associated columnar array 61. Each ground bus 181 is electrically connected to at least one bond pad 74 at one end of the printhead structure and to at least one bond pad 74 at the other end of the printhead structure as schematically depicted in FIGS. 1A and 1B.

The ground busses 181 and heater resistor leads 57*a* are formed in the metallization layer 111*d* (FIG. 5) of the thin film substructure 11, as are the heater resistor leads 57*b,* and the drain and source electrodes of the FET drive circuits 85 described further herein.

The FET drive circuits 85 of each columnar array of FET drive circuits are controlled by an associated columnar array 31 of decoder logic circuits 35 that decode address information on an adjacent address bus 33 that is connected to appropriate bond pads 74 (FIG. 6). The address information identifies the ink drop generators that are to be energized with ink firing energy, as discussed further herein, and is utilized by the decoder logic circuits 35 to turn on the FET drive circuit of an addressed or selected ink drop generator.

Figure 7:
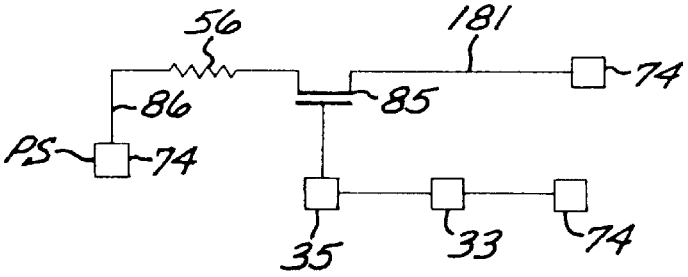
FIG. 7 is an electrical circuit schematic depicting the electrical connections of a heater resistor and an PET drive circuit of the printheads of FIGS. 1A and 1B.

As schematically depicted in FIG. 7, one terminal of each heater resistor 56 is connected via a primitive select trace to a bond pad 74 that receives an ink firing primitive select signal PS. In this manner, since the other terminal of each heater resistor 56 is connected to the drain terminal of an associated FET drive circuit 85, ink firing energy PS is provided to the heater resistor 56 if the associated FET drive circuit is ON as controlled by the associated decoder logic circuit 35.

Figure 8:
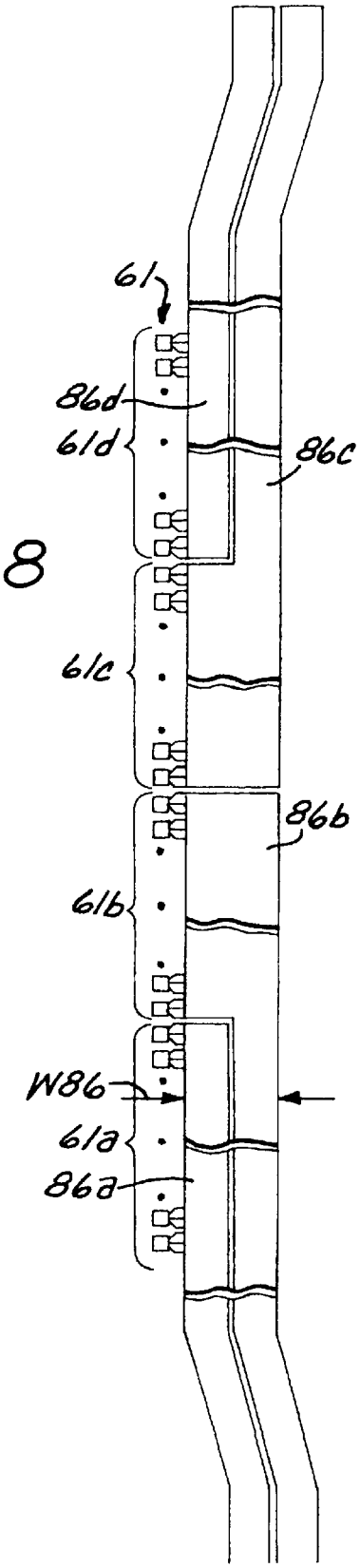
FIG. 8 is a schematic plan view of representative primitive select traces of the printheads of FIGS. 1A and 1B.

As schematically depicted in FIG. 8 for a representative columnar array 61 of ink drop generators, the ink drop generators of a columnar array 61 of ink drop generators can be organized into four primitive groups 61*a,* 61*b*, 61*c*, 61*d* of contiguously adjacent ink drop generators, and the heater resistors 56 of a particular primitive group are electrically connected to the same one of four primitive select traces 86*a*, 86*b*, 86*c*, 86*d*, such that the ink drop generators of a particular primitive group are switchably coupled in parallel to the same ink firing primitive select signal PS. For the specific example wherein the number N of ink drop generators in a columnar array is an integral multiple of 4, each primitive group includes N/4 ink drop generators. For reference, the primitive groups 61*a,* 61*b*, 61*c*, 61*d* are arranged in sequence from the lateral edge 53 toward the lateral edge 54.

FIG. 8 more particularly sets forth a schematic top plan view of primitive select traces 86*a*, 86*b*, 86*c*, 86*d* for an associated columnar array 61 of drop generators and an associated columnar array 81 of FET drive circuits 85 (FIG. 6) as implemented for example by traces in the gold metallization layer 111*g* (FIG. 5) that is above and dielectrically separated from the associated array 81 of FET drive circuit and ground bus 181. The primitive select traces 86*a*, 86*b*, 86*c*, 86*d* are respectively electrically connected to the four primitive groups 61*a,* 61*b*, 61*c*, 61*d* by resistor leads 57*b* (FIG. 8) formed in the metallization layer 111*d* and interconnecting vias 58 (FIG. 9) that extend between the primitive select traces and the resistor leads 57*b*.

The first primitive select trace 86*a* extends longitudinally along the first primitive group 61*a* and overlies a portion of heater resistor leads 57*b* (FIG. 9) that are respectively connected to heater resistors 56 of the first primitive group 61*a,* and is connected by vias 58 (FIG. 9) to such heater resistor leads 57*b*. The second primitive select trace 86*b* includes a section that extends along the second primitive group 61*b* and overlies a portion of heater resistor leads 57*b* (FIG. 9) that are respectively connected to heater resistors 56 of the second primitive group 61*b*, and is connected by vias 58 to such heater resistor leads 57*b*. The second trace 86*b* includes a further section that extends along the first primitive select trace 86*a* on the side of the first primitive select trace 86*a* that is opposite the heater resistors 56 of the first primitive group 61*a*. The second primitive select trace 86*b* is generally L-shaped wherein the second section is narrower than the first section so as to bypass the first primitive select trace 86*a* which is narrower than the wider section of the second primitive select trace 86*b*.

The first and second primitive select traces 86*a*, 86*b* are generally at least coextensive longitudinally with the first and second primitive groups 61*a,* 61*b*, and are respectively appropriately connected to respective bond pads 74 disposed at the lateral edge 53 which is closest to the first and second primitive select traces 86*a*, 86*b*.

The fourth primitive select trace 86*d* extends longitudinally along the fourth primitive group 61*d* and overlies a portion of heater resistor leads 57*b* (FIG. 9) that are connected to heater resistors 56 of the fourth primitive group 61*d*, and is connected by vias 58 to such heater resistor leads 57*b*. The third primitive select trace 86*c* includes a section that extends along the third primitive group 61*c* and overlies a portion of heater resistor leads 57*b* (FIG. 9) that are connected to heater resistors 56 of the third primitive group 61*c*, and is connected by vias 58 to such heater resistor leads 57*b*. The third primitive select trace 86*c* includes a further section that extends along the fourth primitive select trace 86*d*. The third primitive select trace 86*c* is generally L-shaped wherein the second section is narrower than the first section so as to bypass the fourth primitive select trace 86*d* which is narrower than the wider section of the third primitive select trace 86*c*.

The third and fourth primitive select traces 86*c*, 86*d* are generally at least coextensive longitudinally with the third and fourth primitive groups 61*c*, 61*d*, and are respectively appropriately connected to bond pads 74 disposed at the lateral edge 54 that is closest to the third and fourth primitive select traces 86*c*, 86*d*.

By way of specific example, the primitive select traces 86*a*, 86*b*, 86*c*, 86*d* for a columnar array 61 of ink drop generators overlie the FET drive circuits and the ground bus associated with the columnar array of ink drop generators, and are contained in a region that is longitudinally coextensive with the associated columnar array 61. In this manner, four primitive select traces for the four primitives of a columnar array 61 of ink drop generators extend along the array toward the ends of the printhead substrate. More particularly, a first pair of primitive select traces for a first pair of primitive groups 61*a*, 61*b* disposed in one-half of the length of the printhead substrate are contained in a region that extends along such first pair of primitive groups, while a second pair of primitive select traces for a second pair of primitive groups 61*c*, 61*d* disposed in the other half of the length of the printhead substrate are contained in a region that extends along such second pair of primitive groups.

For ease of reference, the primitive select traces 86 and the associated ground bus that electrically connect the heater resistors 56 and associated FET drive circuits 85 to bond pads 74 are collectively referred to as power traces. Also for ease of reference, the primitive select traces 86 can be referred to as to the high side or non-grounded power traces.

Generally, the parasitic resistance (or on-resistance) of each of the FET drive circuits 85 is configured to compensate for the variation in the parasitic resistance presented to the different FET drive circuits 85 by the parasitic path formed by the power traces, so as to reduce the variation in the energy provided to the heater resistors. In particular, the power traces form a parasitic path that presents a parasitic resistance to the FET circuits that varies with location on the path, and the parasitic resistance of each of the FET drive circuits 85 is selected so that the combination of the parasitic resistance of each FET drive circuit 85 and the parasitic resistance of the power traces as presented to the FET drive circuit varies only slightly from one ink drop generator to another. Insofar as the heater resistors 56 are all of substantially the same resistance, the parasitic resistance of each FET drive circuit 85 is thus configured to compensate for the variation of the parasitic resistance of the associated power traces as presented to the different FET drive circuits 85. In this manner, to the extent that substantially equal energies are provided to the bond pads connected to the power traces, substantially equal energies can be provided to the different heater resistors 56.

Figure 10:
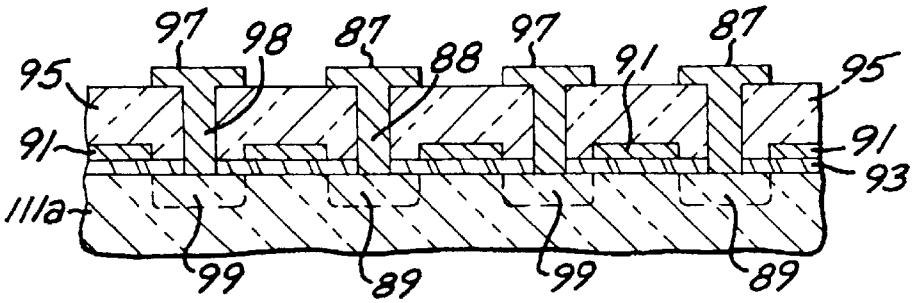
FIG. 10 is a schematic elevational cross sectional view of the FET drive circuit of FIG. 9.

Referring more particularly to FIGS. 9 and 10, each of the FET drive circuits 85 comprises a plurality of electrically interconnected drain electrode fingers 87 disposed over drain region fingers 89 formed in the silicon substrate 111*a* (FIG. 5), and a plurality of electrically interconnected source electrode fingers 97 interdigitated or interleaved with the drain electrodes 87 and disposed over source region fingers 99 formed in the silicon substrate 111*a*. Polysilicon gate fingers 91 that are interconnected at respective ends are disposed on a thin gate oxide layer 93 formed on the silicon substrate 111*a*. A phosphosilicate glass layer 95 separates the drain electrodes 87 and the source electrodes 97 from the silicon substrate 111*a*. A plurality of conductive drain contacts 88 electrically connect the drain electrodes 87 to the drain regions 89, while a plurality of conductive source contacts 98 electrically connect the source electrodes 97 to the source regions 99.

The area occupied by each FET drive circuit is preferably small, and the on-resistance of each FET drive circuit is preferrably low, for example less than or equal to 14 or 16 ohms (i.e., at most 14 or 16 ohms), which requires efficient FET drive circuits. For example, the on-resistance Ron can be related to FET drive circuit area A as follows:

$$Ron<(250{,}000\ \text{ohms}\cdot\text{micrometer}^2)/A$$

wherein the area A is in micrometers$^2$ ($\mu m^2$). This can be accomplished by for example with a gate oxide layer 93 having a thickness that is less than or equal to 800 Angstroms (i.e., at most 800 Angstroms), or a gate length that is less than 4 $\mu$m. Also, having a heater resistor resistance of at least 100 ohms allows the FET circuits to be made smaller than if the heater resistors had a lower resistance, since with a greater heater resistor value a greater FET turn-on resistance can be tolerated from a consideration of distribution of energy between parasitics and the heater resistors.

As a particular example, the drain electrodes 87, drain regions 89, source electrodes 97, source regions 99, and the polysilicon gate fingers 91 can extend substantially orthogonally or transversely to the reference axis L and to the longitudinal extent of the ground busses 181. Also, for each FET circuit 85, the extent of the drain regions 89 and the source regions 99 transversely to the reference axis L is the same as extent of the gate fingers transversely to the reference axis L, as shown in FIG. 6, which defines the extent of the active regions transversely to the reference axis L. For ease of reference, the extent of the drain electrode fingers 87, drain region fingers 89, source electrode fingers 97, source region fingers 99, and polysilicon gate fingers 91 can be referred to as the longitudinal extent of such elements insofar as such elements are long and narrow in a strip-like or finger-like manner.

By way of illustrative example, the on-resistance of each of the FET circuits 85 is individually configured by controlling the longitudinal extent or length of a continuously non-contacted segment of the drain region fingers, wherein a continuously non-contacted segment is devoid of electrical contacts 88. For example, the continuously non-contacted segments of the drain region fingers can begin at the ends of the drain regions 89 that are furthest from the heater resistor 56. The on-resistance of a particular FET circuit 85 increases with increasing length of the continuously non-contacted drain region finger segment, and such length is selected to determine the on-resistance of a particular FET circuit.

As another example, the on-resistance of each FET circuit 85 can be configured by selecting the size of the FET circuit. For example, the extent of an FET circuit transversely to the reference axis L can be selected to define the on-resistance.

For a typical implementation wherein the power traces for a particular FET circuit 85 are routed by reasonably direct paths to bond pads 74 on the closest of the longitudinally separated ends of the printhead structure, parasitic resistance increases with distance from the closest end of the printhead, and the on-resistance of the FET drive circuits 85 is decreased (making an FET circuit more efficient) with distance from such closest end, so as to offset the increase in power trace parasitic resistance. As a specific example, as to continuously non-contacted drain finger segments of the respective FET drive circuits 85 that start at the ends of the drain region fingers that are furthest from the heater resistors 56, the lengths of such segments are decreased with distance from the closest one of the longitudinally separated ends of the printhead structure.

Each ground bus 181 is formed of the same thin film metallization layer as the drain electrodes 87 and the source electrodes 97 of the FET circuits 85, and the active areas of each of the FET circuits comprised of the source and drain regions 89, 99 and the polysilicon gates 91 advantageously extend beneath an associated ground bus 181. This allows the ground bus and FET circuit arrays to occupy narrower regions which in turn allows for a narrower, and thus less costly, thin film substructure.

Also, in an implementation wherein the continuously non-contacted segments of the drain region fingers start at the ends of the drain region fingers that are furthest from the heater resistors 56, the extent of each ground bus 181 transversely or laterally to the reference axis L and toward the associated heater resistors 56 can be increased as the length of the continuously non-contacted drain finger sections is increased, since the drain electrodes do not need to extend over such continuously non-contacted drain finger sections. In other words, the width W of a ground bus 181 can be increased by increasing the amount by which the ground bus overlies the active regions of the FET drive circuits 85, depending upon the length of the continuously non-contacted drain region segments. This is achieved without increasing the width of the region occupied by a ground bus 181 and its associated FET drive circuit array 81 since the increase is achieved by increasing the amount of overlap between the ground bus and the active regions of the FET drive circuits 85. Effectively, at any particular FET circuit 85, the ground bus can overlap the active region transversely to the reference axis L by substantially the length of the non-contacted segments of the drain regions.

For the specific example wherein the continuously non-contacted drain region segments start at the ends of the drain region fingers that are furthest from the heater resistors 56 and wherein the lengths of such continuously non-contacted drain region segments decrease with distance from the closest end of the printhead structure, the modulation or variation of the width W of a ground bus 181 with the variation of the length of the continuously non-contacted drain region segments provides for a ground bus having a width W181 that increases with proximity to the closest end of the printhead structure, as depicted in FIG. 8. Since the amount of shared currents increases with proximity to the bonds pads 74, such shape advantageously provides for decreased ground bus resistance with proximity to the bond pads 74.

Ground bus resistance can also be reduced by laterally extending portions of the ground bus 181 into longitudinally spaced apart areas between the decoder logic circuits 35. For example, such portions can extend laterally beyond the active regions by the width of the region in which the decoder logic circuits 35 are formed.

The following circuitry portions associated with a columnar array of ink drop generators can be contained in respective regions having the following widths that are indicated in FIGS. 6 and 8 by the reference designations that follow the width values.

| REGIONS THAT CONTAIN: | WIDTH |
|---|---|
| Resistor leads 57 | About 95 micrometers ($\mu$m) or less (W57) |
| FET circuits 81 | At most 350 $\mu$m or 220 $\mu$m for printhead 100A, and at most 250 $\mu$m or 180 $\mu$m for printhead 100B (W81) |
| Decode logic circuits 31 | About 34 $\mu$m or less (W31) |
| Primitive select traces 86 | About 290 $\mu$m or less (W86) |

These widths are measured orthogonally or laterally to the longitudinal extent of the printhead substrate which is aligned with the reference axis L.

Figure 11:
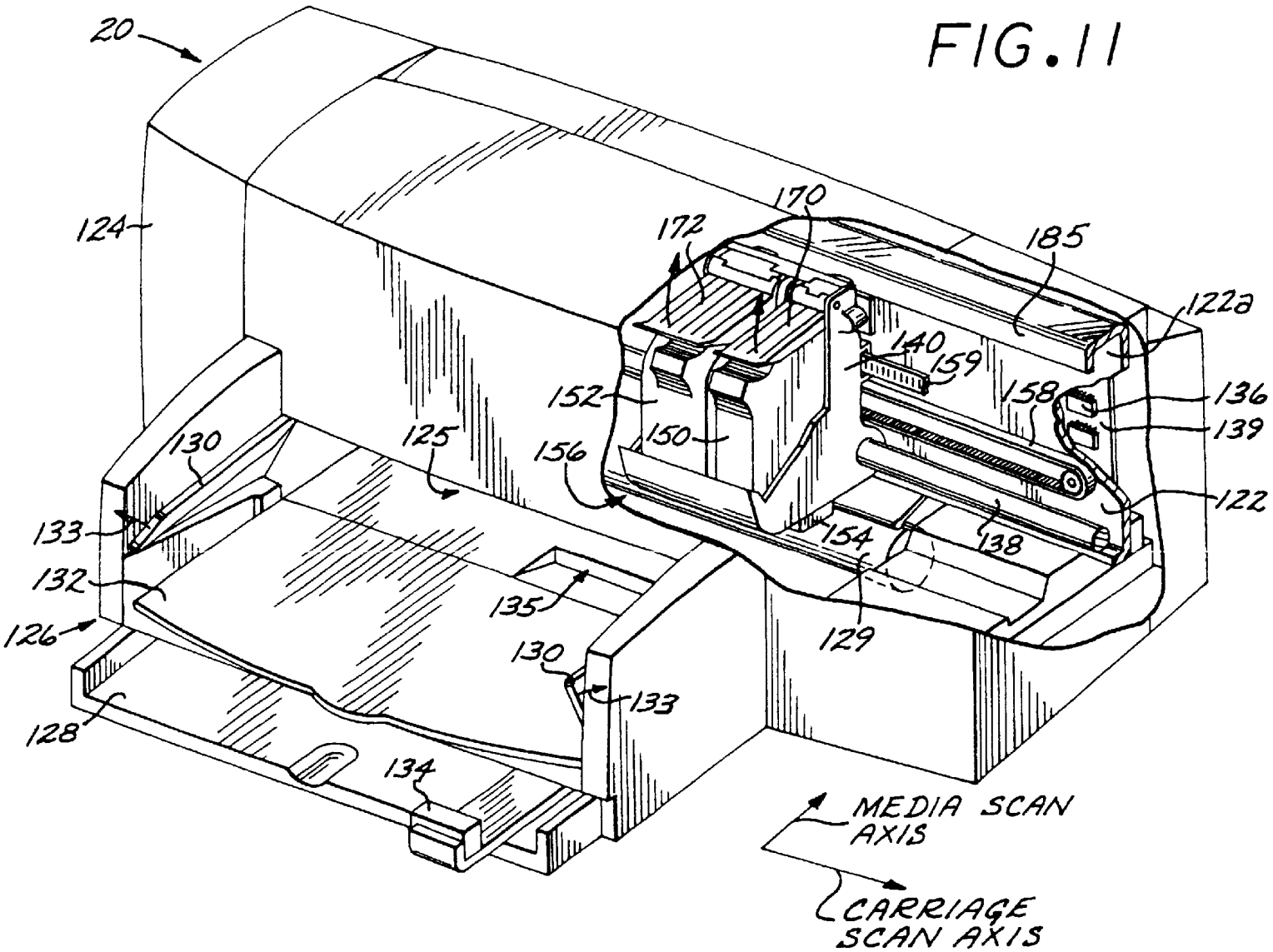
FIG. 11 is an unscaled schematic perspective view of a printer in which the printhead of the invention can be employed.

Referring now to FIG. 11, set forth therein is a schematic perspective view of an example of an ink jet printing device 20 in which the above described printheads can be employed. The ink jet printing device 20 of FIG. 11 includes a chassis 122 surrounded by a housing or enclosure 124, typically of a molded plastic material. The chassis 122 is formed for example of sheet metal and includes a vertical panel 122*a*. Sheets of print media are individually fed through a print zone 125 by an adaptive print media handling system 126 that includes a feed tray 128 for storing print media before printing. The print media may be any type of suitable printable sheet material such as paper, card-stock, transparencies, Mylar, and the like, but for convenience the illustrated embodiments described as using paper as the print medium. A series of conventional motor-driven rollers including a drive roller 129 driven by a stepper motor may be used to move print media from the feed tray 128 into the print zone 125. After printing, the drive roller 129 drives the printed sheet onto a pair of retractable output drying wing members 130 which are shown extended to receive a printed sheet. The wing members 130 hold the newly printed sheet for a short time above any previously printed sheets still drying in an output tray 132 before pivotally retracting to the sides, as shown by curved arrows 133, to drop the newly printed sheet into the output tray 132. The print media handling system may include a series of adjustment mechanisms for accommodating different sizes of print media, including letter, legal, A-4, envelopes, etc., such as a sliding length adjustment arm 134 and an envelope feed slot 135.

The printer of FIG. 11 further includes a printer controller 136, schematically illustrated as a microprocessor, disposed on a printed circuit board 139 supported on the rear side of the chassis vertical panel 122*a*. The printer controller 136 receives instructions from a host device such as a personal computer (not shown) and controls the operation of the printer including advance of print media through the print zone 125, movement of a print carriage 140, and application of signals to the ink drop generators 40.

A print carriage slider rod 138 having a longitudinal axis parallel to a carriage scan axis is supported by the chassis 122 to sizeably support a print carriage 140 for reciprocating translational movement or scanning along the carriage scan axis. The print carriage 140 supports first and second removable ink jet printhead cartridges 150, 152 (each of which is sometimes called a "pen," "print cartridge," or "cartridge"). The print cartridges 150, 152 include respective printheads 154, 156 that respectively have generally downwardly facing nozzles for ejecting ink generally downwardly onto a portion of the print media that is in the print zone 125. The print cartridges 150, 152 are more particularly clamped in the print carriage 140 by a latch mechanism that includes clamping levers, latch members or lids 170, 172.

For reference, print media is advanced through the print zone 125 along a media axis which is parallel to the tangent to the portion of the print media that is beneath and traversed by the nozzles of the cartridges 150, 152. If the media axis and the carriage axis are located on the same plane, as shown in FIG. 11, they would be perpendicular to each other.

An anti-rotation mechanism on the back of the print carriage engages a horizontally disposed anti-pivot bar 185 that is formed integrally with the vertical panel 122*a* of the chassis 122, for example, to prevent forward pivoting of the print carriage 140 about the slider rod 138.

By way of illustrative example, the print cartridge 150 is a monochrome printing cartridge while the print cartridge 152 is a tri-color printing cartridge.

The print carriage 140 is driven along the slider rod 138 by an endless belt 158 which can be driven in a conventional manner, and a linear encoder strip 159 is utilized to detect position of the print carriage 140 along the carriage scan axis, for example in accordance with conventional techniques.

Although the foregoing has been a description and illustration of specific embodiments of the invention, various modifications and changes thereto can be made by persons skilled in the art without departing from the scope and spirit of the invention as defined by the following claims.

What is claimed is:

1. An ink jet printhead comprising:

a printhead substrate including a plurality of thin film layers;

a columnar array of drop generators defined in said printhead substrate and extending along a longitudinal axis L;

each drop generator having a heater resistor having a resistance of at least 100 ohms; and a columnar array of FET circuits formed in said printhead substrate and respectively connected to said drop generators, said FET circuits including active regions each comprised of drain regions, source regions, and a gate disposed on a gate oxide layer, said columnar array of FET circuits contained in an FET region having a width that is orthogonal to said longitudinal axis L, said width being at most 350 micrometers.

2. The printhead of claim 1 wherein said gate oxide layer has a thickness of at most 800 Angstroms.

3. The printhead of claim 1 wherein each of said FET circuits has a gate length that is less than 4 micrometers.

4. The printhead of claim 1 wherein each of said FET circuits has an on-resistance of at most 16 ohms.

5. The printhead of claim 1 wherein each of said FET circuits has an on-resistance of at most 14 ohms.

6. The printhead of claim 1 wherein said power traces includes a ground bus that overlaps said columnar array of FET drive circuits.

7. The printhead of claim 6 wherein said ground bus has a width transversely to the longitudinal reference axis L that varies along the longitudinal reference axis L.

8. The printhead of claim 1 further including primitive select power traces connected to said drop generators and said FET drive circuits, said primitive select power traces overlying said columnar array of FET drive circuits.

9. The printhead of claim 1 wherein said heater resistor resistance is at least 120 ohms.

10. An ink jet printhead comprising:

a printhead substrate including a plurality of thin film layers;

a columnar array of drop generators defined in said printhead substrate and extending along a longitudinal axis L;

each drop generator having a heater resistor having a resistance of at least 100 ohms;

a columnar array of FET circuits formed in said printhead substrate and respectively connected to said drop generators, said FET circuits including active regions each comprised of drain regions, source regions, and a gate disposed on a gate oxide layer; and each of said FET circuits having a gate length that is less than 4 micrometers.

11. The printhead of claim 10 wherein said gate oxide layer has a thickness of at most 800 Angstroms.

12. The printhead of claim 10 wherein each of said FET circuits has an on-resistance of at most 16 ohms.

13. The printhead of claim 10 wherein each of said FET circuits has an on-resistance of at most 14 ohms.

14. The printhead of claim 10 wherein said power traces includes a ground bus that overlaps said columnar array of FET drive circuits.

15. The printhead of claim 14 wherein said ground bus has a width transversely to the longitudinal reference axis L that varies along the longitudinal reference axis L.

16. The printhead of claim 10 further including primitive select power traces connected to said drop generators and said FET drive circuits, said primitive select power traces overlying said columnar array of FET drive circuits.

17. The printhead of claim 10 wherein said heater resistor resistance is at least 120 ohms.

18. An ink jet printhead comprising:

a printhead substrate including a plurality of thin film layers;

a columnar array of drop generators defined in said printhead substrate and extending along a longitudinal axis L;

each drop generator having a heater resistor having a resistance of at least 100 ohms;

a columnar array of FET circuits formed in said printhead substrate and respectively connected to said drop generators, said FET circuits including active regions each comprised of drain regions, source regions, and a gate disposed on a gate oxide layer; and each of said FET circuits having an on-resistance of at most 14 ohms.

19. The printhead of claim 18 wherein said gate oxide layer has a thickness of at most 800 Angstroms.

20. The printhead of claim 18 wherein said power traces includes a ground bus that overlaps said columnar array of FET drive circuits.

21. The printhead of claim 20 wherein said ground bus has a width transversely to the longitudinal reference axis L that varies along the longitudinal reference axis L.

22. The printhead of claim 18 further including primitive select power traces connected to said drop generators and said FET drive circuits, said primitive select power traces overlying said columnar array of FET drive circuits.

23. The printhead of claim 18 wherein said heater resistor resistance is at least 120 ohms.

24. An ink jet printhead comprising:

a printhead substrate including a plurality of thin film layers;

a columnar array of drop generators defined in said printhead substrate and extending along a longitudinal axis L;

each drop generator having a heater resistor having a resistance of at least 100 ohms;

a columnar array of FET circuits formed in said printhead substrate and respectively connected to said drop generators, said FET circuits including active regions each comprised of drain regions, source regions, and a gate disposed on a gate oxide layer;

said columnar array of FET circuits contained in an FET region having a width that is orthogonal to said longitudinal axis L, said width being at most 350 micrometers;

each of said FET circuits having a gate length that is less than 4 micrometers; and each of said FET circuits having an on-resistance of at most 14 ohms.

25. The printhead of claim 24 wherein said gate oxide layer has a thickness of at most 800 Angstroms.

26. (New) The printhead of claim 24 wherein said power traces includes a ground bus that overlaps said columnar array of FET drive circuits.

27. The printhead of claim 26 wherein said ground bus has a width transversely to the longitudinal reference axis L that varies along the longitudinal reference axis L.

28. The printhead of claim 26 further including primitive select power traces connected to said drop generators and said FET drive circuits, said primitive select power traces overlying said columnar array of FET drive circuits.

29. The printhead of claim 24 wherein said heater resistor resistance is at least 120 ohms.

* * * * *